US009735498B2

(12) United States Patent
Katsube et al.

(10) Patent No.: US 9,735,498 B2
(45) Date of Patent: Aug. 15, 2017

(54) ELECTRONIC DEVICE AND METHOD FOR MANUFACTURING THE SAME

(71) Applicant: OMRON Corporation, Kyoto-shi, Kyoto (JP)

(72) Inventors: Shinya Katsube, Okayama (JP); Taijiro Fujiwara, Okayama (JP); Masaki Nakamura, Kyoto (JP)

(73) Assignee: OMRON Corporation, Kyoto-shi (JP)

( * ) Notice: Subject to any disclaimer, the term of this patent is extended or adjusted under 35 U.S.C. 154(b) by 0 days.

(21) Appl. No.: 15/361,284

(22) Filed: Nov. 25, 2016

(65) Prior Publication Data

US 2017/0187144 A1 Jun. 29, 2017

(30) Foreign Application Priority Data

Dec. 25, 2015 (JP) ..... 2015-255248

(51) Int. Cl.

| | |
|---|---|
| ***H01R 13/52*** | (2006.01) |
| ***H01B 7/282*** | (2006.01) |
| ***H01B 3/44*** | (2006.01) |
| ***H01B 3/30*** | (2006.01) |
| ***H01B 13/06*** | (2006.01) |
| ***H01B 13/00*** | (2006.01) |
| ***H01B 7/02*** | (2006.01) |
| ***H01R 24/28*** | (2011.01) |
| ***H01R 13/622*** | (2006.01) |
| *H01R 105/00* | (2006.01) |

(52) U.S. Cl.

CPC ..... *H01R 13/5216* (2013.01); *H01B 3/306* (2013.01); *H01B 3/445* (2013.01); *H01B 7/0208* (2013.01); *H01B 7/2825* (2013.01); *H01B 13/0036* (2013.01); *H01B 13/06* (2013.01); *H01R 13/5205* (2013.01); *H01R 13/622* (2013.01); *H01R 24/28* (2013.01); *H01R 2105/00* (2013.01)

(58) Field of Classification Search

CPC ..... H01R 13/5216

See application file for complete search history.

(56) References Cited

U.S. PATENT DOCUMENTS

| | | | | |
|---|---|---|---|---|
| 5,437,563 A * | 8/1995 | Kihira | H01R 13/6593 | 439/275 |
| 6,171,147 B1 * | 1/2001 | Nachbauer | H01R 13/5205 | 439/604 |
| 2008/0227887 A1 * | 9/2008 | Klier | H01B 3/441 | 523/173 |

(Continued)

FOREIGN PATENT DOCUMENTS

JP 2010-277748 A 12/2010

*Primary Examiner* — James Harvey

(74) *Attorney, Agent, or Firm* — Mots Law, PLLC

(57) ABSTRACT

Provided is an electronic device that is highly resistant to a water-soluble grinding oil and a method for manufacturing the same. An electronic device includes a main body and a cable including a lead wire, an insulating portion, and an outer coat, a first sealing portion that covers the insulating portion, and a second sealing portion that seals the first sealing portion, the insulating portion is made of a material that is more resistant to a water-soluble grinding oil than the outer coat is, and the first sealing portion is made of a material that has higher adherence to the insulating portion than that of the second sealing portion does.

7 Claims, 7 Drawing Sheets

(56) References Cited

U.S. PATENT DOCUMENTS

| | | | | |
|---|---|---|---|---|
| 2012/0103655 | A1 | 5/2012 | Imabayashi et al. | |
| 2014/0096992 | A1* | 4/2014 | Williams | E21B 33/04 174/20 |
| 2016/0380379 | A1* | 12/2016 | Riedel | H01R 13/521 439/271 |

* cited by examiner

ELECTRONIC DEVICE AND METHOD FOR MANUFACTURING THE SAME

CROSS-REFERENCES TO RELATED APPLICATIONS

This application claims priority to Japanese Patent Application No. 2015-255248 filed Dec. 25, 2015, the entire contents of which are incorporated herein by reference.

FIELD

The present invention relates to an electronic device and a method for manufacturing the same, and more specifically to an electronic device that is highly resistant to a water-soluble grinding oil and a method for manufacturing the same.

BACKGROUND

Electronic devices used in industrial machinery, such as connectors and sensors, are used in an environment in which they are exposed to liquid such as machine oil. Thus, in such electronic devices, it is necessary to prevent liquid such as machine oil from entering a main body having a function of an electronic device.

For example, an electronic device including a main body, a cable that transmits an electrical signal to the main body, and a jacket that covers the cable is disclosed in JP 2010-277748A. In the electronic device disclosed in JP 2010-277748A, a material obtained by adding a thermoplastic elastomer to a polybutylene terephthalate (PBT) resin is used as the jacket, thereby improving flexibility and oil resistance of the electronic device, and the capability of preventing liquid (e.g., machine oil) from entering the electronic device.

JP 2010-277748A is an example of background art.

SUMMARY

However, although the electronic device disclosed in JP 2010-277748A has a high capability of preventing liquid that enters from the jacket or an interface between the cable and the jacket from entering the electronic device, there is a problem in that no consideration is given to liquid that enters from the cable.

Specifically, an outer coat of the cable disclosed in JP 2010-277748A is made of a polyvinyl chloride resin or a polyurethane resin. Such a resin is inexpensive, but is not highly resistant to a water-soluble grinding oil, which is one type of machine oil. Thus, in some cases, the water-soluble grinding oil may enter the electronic device from the cable due to deterioration of the outer coat of the cable when the electronic device is used. Here, in the electronic device disclosed in JP 2010-277748A, adherence between a lead wire provided in the cable and the jacket is not considered. Therefore, there is a risk that the water-soluble grinding oil that has entered from the outer coat of the cable will travel on the lead wire provided in the cable and enter the main body, and insulation resistance at a contact point of the electronic device will decrease or contact failure will occur.

The present invention has been made in view of the above-described issues, and an object thereof is to provide an electronic device that is highly resistant to a water-soluble grinding oil, and a method for manufacturing the same.

In order to resolve the above-described issues, an electronic device according to the present invention includes a main body having a function of the electronic device, and a cable that has a tip portion disposed inside the main body and is connected to the main body, and the cable includes a lead wire, an insulating portion that covers the lead wire, and an outer coat that covers the insulating portion, the insulating portion protrudes from an end surface on the tip portion side of the outer coat toward the tip portion, and is made of a material that is more resistant to a water-soluble grinding oil than the outer coat is, the electronic device further including a first sealing portion that seals the insulating portion that protrudes from the end surface, and a second sealing portion that seals the first sealing portion and is in contact with the main body and the outer coat, the first sealing portion being made of a material that has higher adherence to the insulating portion than that of the second sealing portion does.

According to the above-described configuration, since the lead wire is covered by the insulating portion, which is made of a material that is more resistant to a water-soluble grinding oil than the outer coat is, even if the outer coat deteriorates and the water-soluble grinding oil enters from the outer coat, it is possible to prevent the lead wire and the water-soluble grinding oil from coming into contact with each other. Also, the insulating portion protruding from the end surface of the outer coat is sealed by the first sealing portion, which is made of a material that has higher adherence to the insulating portion than that of the second sealing portion does, and it is thereby possible to prevent the water-soluble grinding oil from traveling on the interface between the outer coat and the insulating portion and entering the main body. Moreover, since the first sealing portion is sealed by the second sealing portion, it is also possible to prevent the water-soluble grinding oil from entering the main body from the interface between the first sealing portion and the outer coat. Accordingly, it is possible to provide an electronic device that is highly resistant to the water-soluble grinding oil. Note that the lead wire need only include a conducting wire that includes at least a conductor, and may have a coating between the conducting wire and the insulating portion.

Also, in the electronic device according to the present invention, the first sealing portion may seal the end surface of the outer coat.

According to the above-described configuration, the first sealing portion seals the interface between the outer coat of the end surface and the insulating portion due to the first sealing portion sealing the end surface on the tip portion side of the outer coat. Therefore, it is possible to provide an electronic device that is more resistant to the water-soluble grinding oil.

Also, in the electronic device according to the present invention, the first sealing portion may seal the end portion on the tip portion side of the lead wire.

According to the above-described configuration, even if the water-soluble grinding oil enters the main body, it is possible to prevent the lead wire or a terminal from coming into contact with the water-soluble grinding oil due to the end portion on the tip portion side of the lead wire being sealed. Therefore, it is possible to provide an electronic device that is highly resistant to the water-soluble grinding oil.

Also, in the electronic device according to the present invention, the second sealing portion may be made of a material that has higher adherence to the outer coat than that of the first sealing portion does.

According to the above-described configuration, since the second sealing portion is made of a material that has higher adherence to the outer coat than that of the first sealing portion does, the adherence of the interface between the outer coat and the second sealing portion is increased, and it is possible to prevent the water-soluble grinding oil from entering the main body from the interface between the second sealing portion and the outer coat.

Also, in the electronic device according to the present invention, the material for forming the insulating portion may be a fluorine-based resin, and the material for forming the first sealing portion may be a polyamide-based resin.

According to the above-described configuration, using a fluororesin that is highly resistant to a water-soluble grinding oil as the material for forming the insulating portion and using a polyamide resin that has high adherence to a fluororesin as the material for the first sealing portion makes it possible to provide an electronic device that is highly resistant to the water-soluble grinding oil.

Also, in the electronic device according to the present invention, a material for forming the outer coat may be a polyvinyl chloride resin, and the material for forming the second sealing portion may be a polybutylene terephthalate resin.

According to the above-described configuration, a polyvinyl chloride resin that is an inexpensive material is used as the outer coat, and a polybutylene terephthalate resin that has good adherence to a polyvinyl chloride resin and is highly resistant to a water-soluble grinding oil is used as the second sealing portion, and thus an electronic device that is highly resistant to the water-soluble grinding oil can be provided at a low cost.

Also, a method for manufacturing an electronic device according to the present invention is a method for manufacturing an electronic device including a main body having a function of the electronic device, and a cable that has a tip portion disposed inside the main body and is connected to the main body, the method including a step of disposing, in the main body, a tip portion of the cable including a lead wire, an insulating portion that covers the lead wire, and an outer coat that covers the insulating portion, a step of forming a first sealing portion that seals the insulating portion that protrudes from an end surface on the tip portion side of the outer coat toward the tip portion, and a step of forming a second sealing portion that seals the first sealing portion and is in contact with the main body and the outer coat, and the insulating portion is made of a material that is more resistant to a water-soluble grinding oil than the outer coat is, and the first sealing portion is made of a material that has higher adherence to the insulating portion than that of the second sealing portion does.

According to the above-described configuration, it is possible to provide a method for manufacturing an electronic device that is highly resistant to a water-soluble grinding oil.

According to the present invention, it is possible to provide an electronic device that is highly resistant to a water-soluble grinding oil and a method for manufacturing the same.

DETAILED DESCRIPTION

Hereinafter, embodiments of the present invention will be described in detail with reference to the drawings.

Configuration of Electronic Device

Figure 1A:
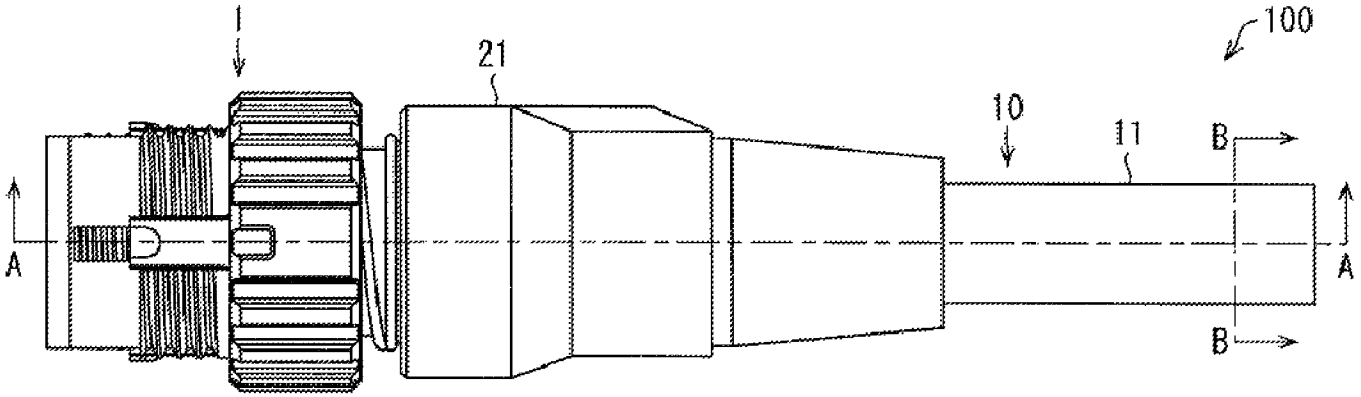
FIGS. 1A and 1B are plan views showing an external appearance of an electronic device according to one embodiment of the present invention.
Figure 1B:
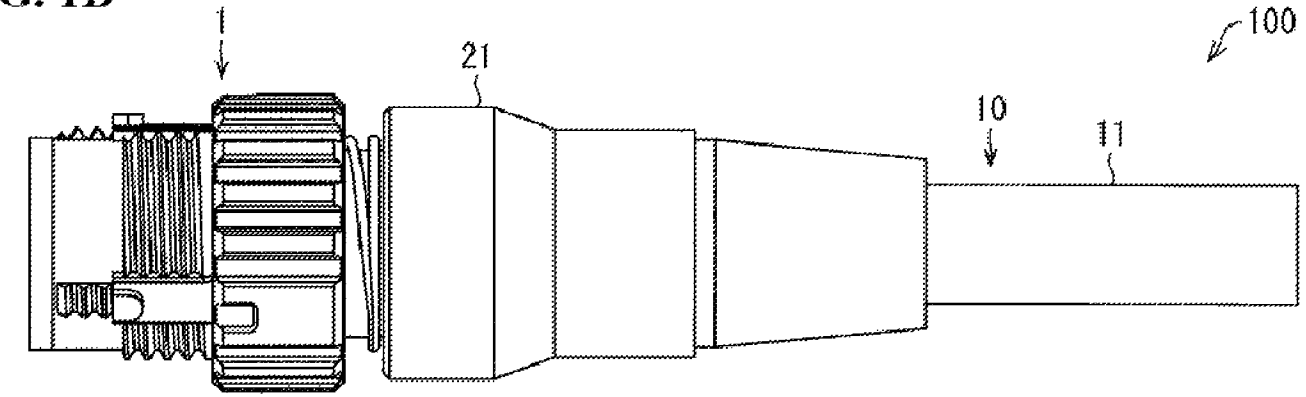
Figure 2:
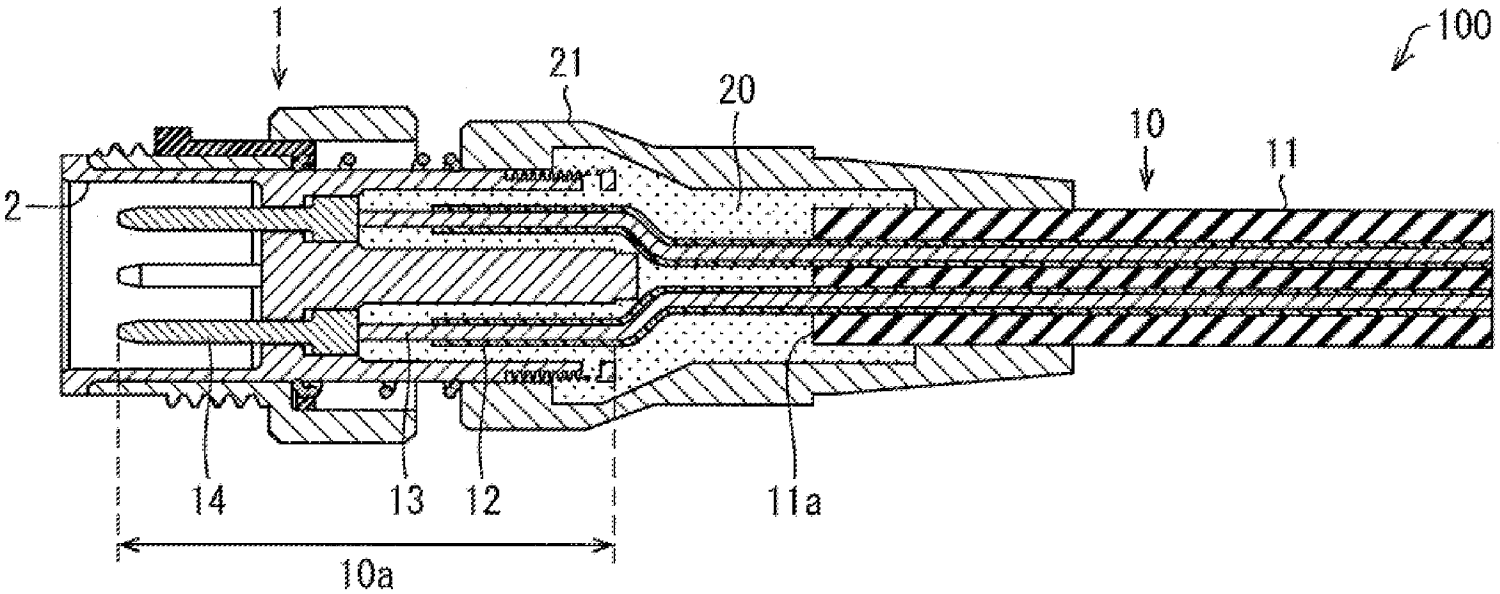
FIG. 2 is a vertical cross-sectional view taken along line A-A in FIG. 1A.
Figure 3:
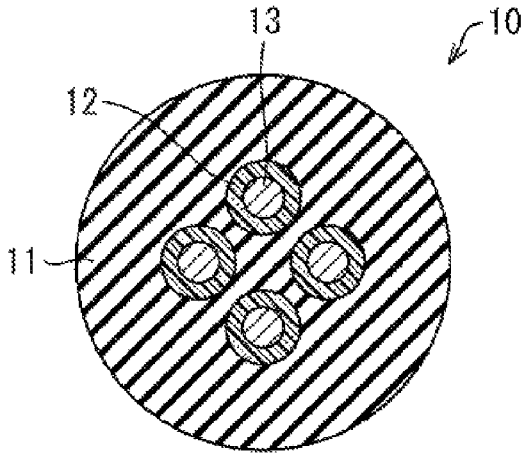
FIG. 3 is a vertical cross-sectional view taken along line B-B in FIG. 1A.

FIGS. 1A and 1B are plan view showing an external appearance of an electronic device 100 according to one embodiment of the present invention, FIG. 1A showing a front view, and FIG. 1B showing a side view. Also, FIG. 2 is a vertical cross-sectional view taken along line A-A in FIG. 1A, and FIG. 3 is a vertical cross-sectional view taken along line B-B in FIG. 1A.

As shown in FIGS. 1A to 3, the electronic device 100 includes a main body 1 having a function of the electronic device 100, a cable 10 that has a tip portion 10*a* disposed inside the main body 1 and that is electrically connected to the main body 1, a first sealing portion 20, and a second sealing portion 21.

The main body 1 is a portion without which the function of the electronic device 100 cannot be carried out. For example, if the electronic device 100 is a connector, the main body 1 is a portion that accommodates a connection terminal, and if the electronic device 100 is a sensor, the main body 1 refers to a portion on which a substrate and the like are mounted. Here, the electronic device 100 such as a connector or a sensor is used in a severe situation in which the electronic device 100 is exposed for a long period of time to liquid such as wax, machine tool oil such as water-soluble grinding oil, and cleaning liquid, in a high-temperature and high-humidity environment such as an automobile factory, for example. Thus, in order to enable the function of the main body 1 to be sufficiently exhibited, it is necessary to prevent liquid from entering the main body 1.

The cable 10 includes lead wires 13 made of a conductor such as copper, insulating portions 12 that cover the lead wires 13, an outer coat 11 that covers a plurality of the lead wires 13 that are covered by the insulating portions 12, and terminals 14 that are electrically connected to the lead wires 13. Also, as shown in FIG. 2, the insulating portion 12 of the cable 10 protrudes from an end surface 11*a* on the tip portion 10*a* side of the outer coat 11 to the tip portion 10*a*. Note that a multi-core cable in which the cable 10 includes the plurality of lead wires 13 is described in the present embodiment, but the cable 10 may be a single-core cable provided with one lead wire 13. Moreover, although a configuration in which the cable 10 includes the terminals 14 that are electrically connected to the lead wires 13 at the tip portion 10*a* is described in the present embodiment, a configuration in which the main body 1 includes the terminals 14 is also possible. Also, although an example in which the lead wires 13 are made of a conductor is described in the present embodiment, the lead wires 13 need only include at least conducting wires made of a conductor. That is, the lead wire 13 may include a cover layer that covers the conducting wire between the conducting wire and the insulating portions 12.

There is no particular limitation on the material for forming the outer coat 11 of the cable 10, and a conventional known material can be used. For example, the material need only be a thermoplastic resin such as a polyethylene resin, a polyvinyl chloride resin, a polyester resin, a polyamide resin, a PE elastomer resin, a PVC elastomer resin, and a polyurethane resin. Among these resins, polyvinyl chloride resins, which are particularly inexpensive, are preferable.

The insulating portions 12 are made of a material that is more resistant to a water-soluble grinding oil than the outer coat 11 of the cable 10 is. Preferably, examples of the material for forming the insulating portion 12 include fluorine-based resins such as ethylene tetrafluoethylene copolymers (ETFE), vinylidene fluoride tetrafluoroethylene hexafluoroethylene copolymers (THV), polytetrafluoroethylene (PTFE), perfluoroalkoxy alkanes (PFA), vinylidene fluoride (PVDF), tetrafluoroethylene (TFE), and hexafluoropropylene (HFP). Note that the details of a method for evaluating the resistance to water-soluble grinding oil will be described later.

Here, as described above, the electronic device 100 needs to prevent entering of liquid represented by a water-soluble grinding oil. A path through which liquid enters the inside of the cable 10 from the outer coat 11, due to deterioration of the outer coat 11 caused by liquid or occurrence of a crack in the outer coat 11 caused by stress concentration, is thought to be one example of a liquid entering path. However, the insulating portions 12 according to the present embodiment are made of a material that is more resistant to a water-soluble grinding oil than the outer coat 11 is. Thus, even if liquid enters the inside of the cable 10 from the outer coat 11, the liquid does not enter inside past the insulating portions 12, and thus it is possible to protect the lead wires 13 and the terminals 14.

Also, using a material that is highly resistant to a water-soluble grinding oil not for the outer coat 11 but for the insulating portion 12 makes it possible to reduce the use amount of the material that is highly resistant to the water-soluble grinding oil, and to reduce the cost of the electronic device 100.

The first sealing portion 20 is formed by insert molding, and is for covering and protecting the insulating portions 12 in order to prevent liquid from entering the main body 1. A material that has higher adherence to the insulating portion 12 than that of the second sealing portion 21 does is used as the material for forming the first sealing portion 20. Specifically, the first sealing portion 20 is preferably made of a polyamide-based resin such as nylon 6 (PA6), nylon 11 (PA11), nylon 12 (PA12), nylon 46 (PA46), nylon 66 (PA66), nylon 610 (P610), or nylon 1010 (PA1010). Note that the details of a method for evaluating the adherence will be described later.

As shown in FIG. 2, the first sealing portion 20 seals the end surface 11*a* on the tip portion 10*a* side of the outer coat 11, the insulating portions 12 that protrude from the end surface 11*a*, and a portion of the main body 1. Here, the first sealing portion 20 is made of a material that has high adherence to the insulating portions 12. Therefore, even if the outer coat 11 deteriorates due to liquid such as water-soluble grinding oil and the liquid enters the interface between the outer coat 11 and the insulating portions 12 through the outer coat 11, because the end surface 11*a* on the tip portion 10*a* side of the outer coat 11 and the insulating portions 12 that protrude from the end surface 11*a* are sealed by the first sealing portion 20 that has high adherence to the insulating portions 12, it is possible to sufficiently prevent the liquid from going toward the tip portion 10*a* side past the end surface 11*a*, as a result of which it is possible to prevent the liquid from entering the main body 1. Note that an example in which the first sealing portion 20 seals the end surface 11*a* on the tip portion 10*a* side of the outer coat 11, the insulating portions 12 that protrude from the end surface 11*a*, and a portion of the main body 1 has been described in the present embodiment, but the first sealing portion 20 need only seal at least the insulating portions 12 that protrude from the end surface 11*a*.

Also, because the first sealing portion 20 is formed by insert molding, the first sealing portion 20 is in the gap between the main body 1 and the insulating portion 12 of the tip portion 10*a* of the cable 10 that is disposed inside the main body 1. Therefore, end portions of the lead wires 13 on the tip portion 10*a* side are also sealed by the first sealing portion 20. This makes it possible to prevent a decrease in the insulation resistance, occurrence of contact failure, or the like that is caused by the lead wires 13 or the terminals 14 coming into contact with liquid, even if the liquid enters the main body 1.

Note that the adherence between the insulating portions 12 and the first sealing portion 20 may be further improved by performing conventionally known surface treatment such as heat treatment, corona discharge, plasma arc machining, chemical treatment, or machine treatment on outer surfaces of the insulating portions 12.

The second sealing portion 21 is formed by insert molding, and is for covering and protecting the first sealing portion 20 and the outer coat 11 in order to prevent liquid from entering the main body 1. Specifically, the second sealing portion 21 seals the first sealing portion 20 and is in contact with the main body 1 and the outer coat 11. A material that has high adherence to the first sealing portion 20 and the outer coat 11 is preferable, and a material that has higher adherence to the outer coat 11 than that of the first sealing portion 20 does is more preferable as the material for forming the second sealing portion 21. Also, the material for forming the second sealing portion 21 is preferably a material that is highly resistant to a water-soluble grinding oil. For example, polybutylene terephthalate (PBT) resin can be used as the material for forming the second sealing portion 21. In this manner, sealing the first sealing portion 20 with the second sealing portion 21 that has high adherence to both the first sealing portion 20 and the outer coat 11 makes it possible to prevent liquid such as water-soluble grinding oil from entering the main body 1 from the interface between the first sealing portion 20 and the outer coat 11 and the interface between the second sealing portion 21 and the outer coat 11. Also, because the second sealing portion 21 is in contact with the main body 1, it is also possible to prevent the liquid such as the water-soluble grinding oil from entering the main body 1 from the interface between the first sealing portion 20 and the main body 1.

Method for Evaluating Resistance to Water-Soluble Grinding Oil

Next, a method for evaluating resistance to water-soluble grinding oil will be described.

First, a water-soluble grinding oil is diluted with tap water so as to have a predetermined concentration (for example, diluted 20-fold), is heated to a defined temperature (for example, 50° C.), and is held in a thermostat bath. Then, a material that serves as an evaluation target is immersed in the thermostat bath for a predetermined period of time (for example, 240 hours). Note that in an immersion state, the entire material that is the evaluation target is held so as to be immersed in the water-soluble grinding oil.

Then, examination of an external appearance such as whether there are damages such as cracks or blemishes and whether deformation such as warping occurs, and examination regarding whether or not product properties such as insulation resistance are met are performed on the material that has been immersed. Then, the resistance to a water-soluble grinding oil is evaluated using examination results.

As one example of an evaluation method, it is conceivable that the evaluation is performed by measuring a tensile strength of the material before and after the immersion, and using a tensile strength change rate that represents a change rate of the tensile strength before and after the immersion. That is, it can be evaluated that a material having a small change rate of the tensile strength before and after the immersion is the material that is highly resistant to a water-soluble grinding oil. Note that it is preferable that the material used as the insulating portion 12 has a tensile strength change rate of less than 20%.

Method for Evaluating Adherence

Next, a method for evaluating adherence will be described.

First, the material used as the insulating portions 12 is molded into a strip shape, and the molded material is placed in a metal mold. Then, the material used as the first sealing portion 20 is subjected to insert molding so as to obtain a test piece in which the material used as the insulating portions 12 and the material used as the first sealing portion 20 are joined. The test piece obtained in this manner is used to measure a tensile strength by pulling two ends of the test piece with a tension tester. Similarly, test pieces for the material used as the insulating portions 12 and the material used as the outer coat 11 are also produced, and tensile test is performed to measure the tensile strengths. Then, comparing the measured tensile strengths, a material having a high tensile strength can be evaluated as the material that has high adherence to the insulating portions 12.

Note that the method for evaluating adherence is not limited to this, and for example, solubility parameters (SP values) are used, and materials having close solubility parameters may be evaluated as materials having high adherence.

Method for Manufacturing Electronic Device

Next, a method for manufacturing the electronic device 100 will be described with reference to FIGS. 4A to 7B.

FIGS. 4A to 7B are diagrams showing steps in the method for manufacturing the electronic device 100. In the diagrams, FIGS. 4A, 5A, 6A, and 7A show a plan view, and FIGS. 4B, 5B, 6B, and 7B show a vertical cross-sectional view in FIGS. 4A, 5A, 6A, and 7A.

Attaching Step

Figure 4A:
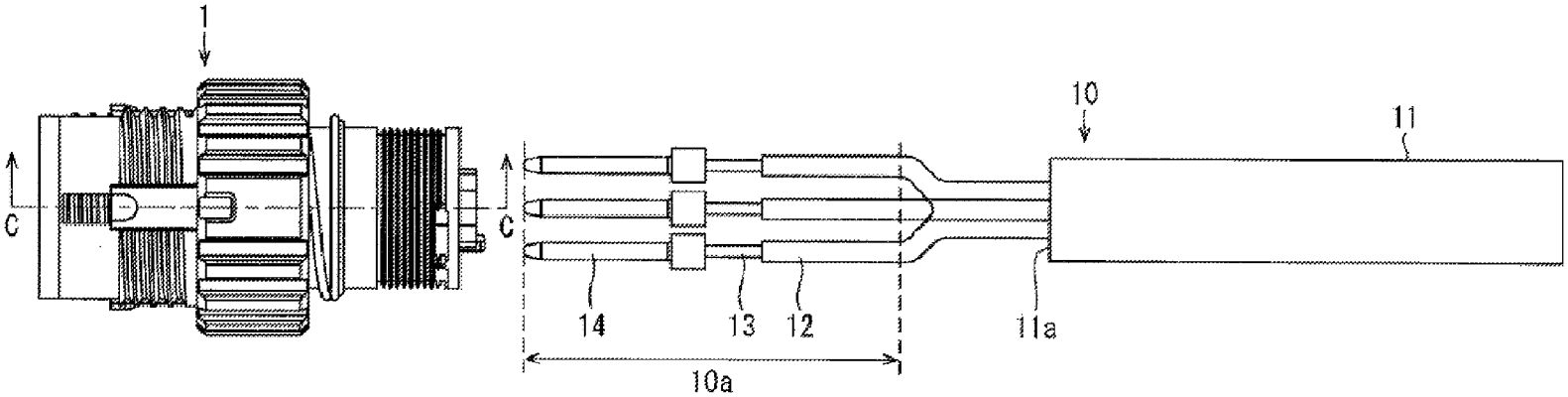
FIGS. 4A and 4B are diagrams showing one step in a method for manufacturing an electronic device shown in FIGS. 1A and 1B.
Figure 4B:
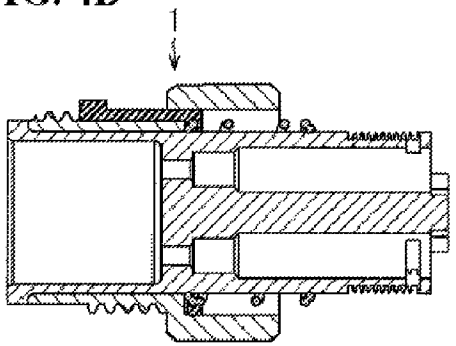
Figure 5A:
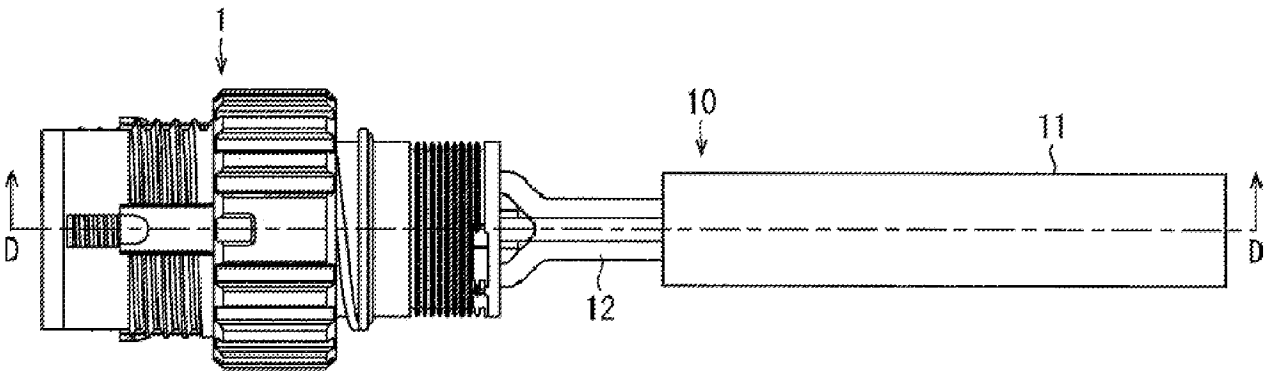
FIGS. 5A and 5B are diagrams showing an attaching step in the method for manufacturing an electronic device shown in FIGS. 1A and 1B.
Figure 5B:
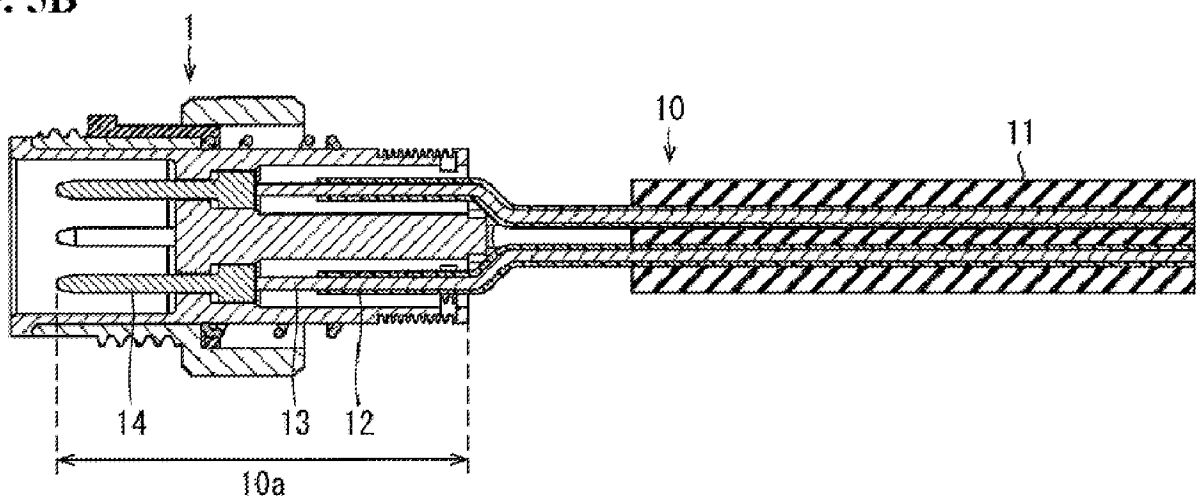

First, as shown in FIGS. 5A and 5B, the tip portion 10*a* of the cable 10 is attached in the main body 1 using the main body 1 and the cable 10 as shown in FIGS. 4A and 4B. Here, as shown in FIGS. 5A and 5B, the cable 10 is provided such that the insulating portions 12 protrude from the end surface 11*a* on the tip portion 10*a* side of the outer coat 11, and thus in a state in which the tip portion 10*a* of the cable 10 is attached in the main body 1 as shown in FIGS. 5A and 5B, at least portions of the insulating portions 12 are exposed.

First Sealing Step

Figure 6A:
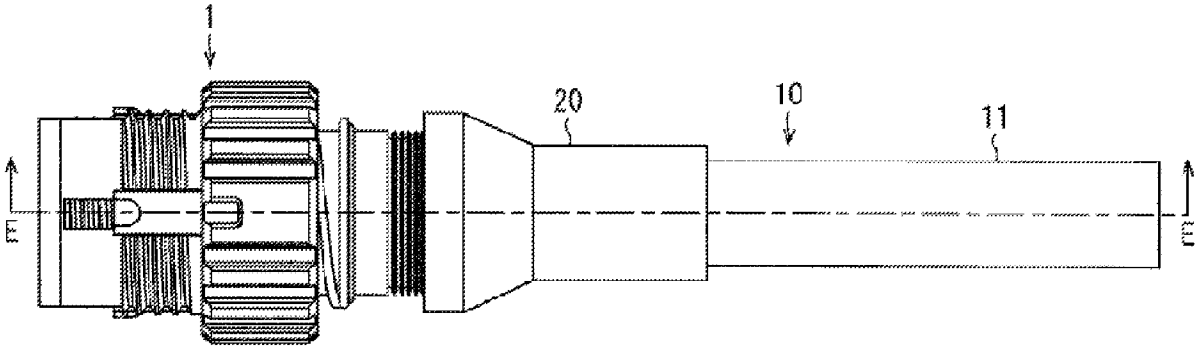
FIGS. 6A and 6B are diagrams showing a first sealing step in the method for manufacturing an electronic device shown in FIGS. 1A and 1B.
Figure 6B:
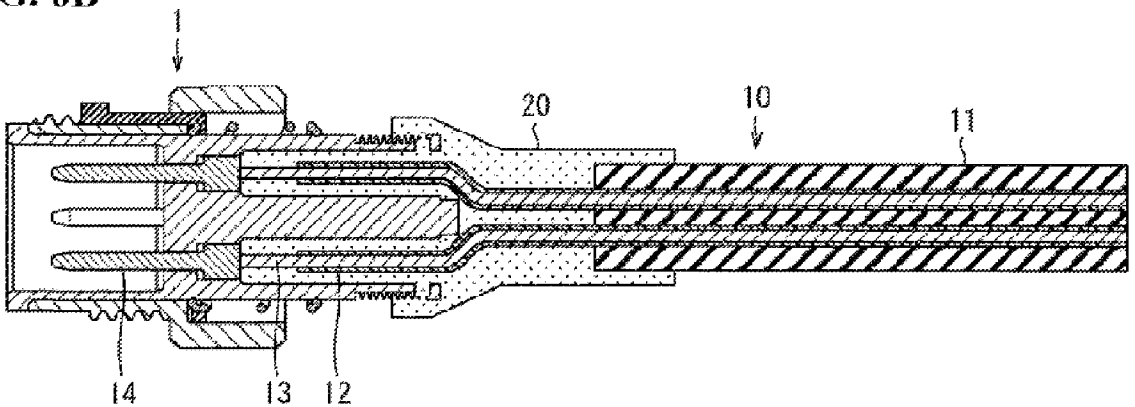

Next, as shown in FIGS. 6A and 6B, in order to seal the exposed insulating portions 12, the first sealing portion 20 is molded by insert molding. Specifically, the cable 10 to which the main body 1 has been attached is placed in the metal mold, and the material for the first sealing portion 20 is injected into the metal mold to mold the first sealing portion 20. At this time, the end surface 11*a* of the outer coat 11, and the insulating portions 12 that protrude from the end surface 11*a* of the outer coat 11 are sealed by the first sealing portion 20. Also, because the first sealing portion 20 is formed by insert molding, the first sealing portion 20 also is in the gap formed between the main body 1 and the tip portion 10*a* of the cable 10, and thus the end portions of the lead wires 13 on the tip portion 10*a* side are sealed by the first sealing portion 20. This makes it possible to make the connection between the cable 10 and the main body 1 strong and prevent liquid from entering the main body 1 from the gap.

Second Sealing Step

Figure 7A:
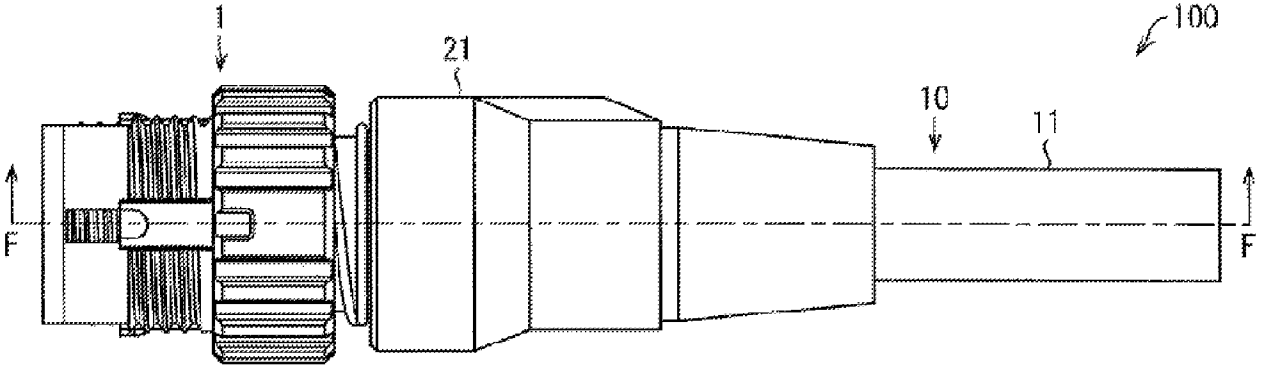
FIGS. 7A and 7B are diagrams showing a second sealing step in the method for manufacturing an electronic device shown in FIGS. 1A and 1B.
Figure 7B:
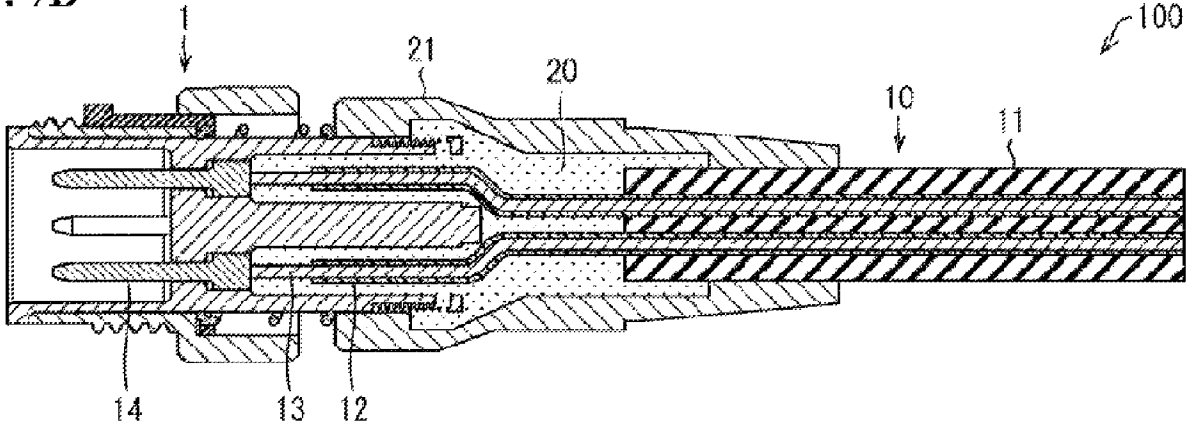

Next, as shown in FIGS. 7A and 7B, in order to seal the exposed first sealing portion 20, the second sealing portion 21 is molded by insert molding. Specifically, the main body 1 provided with the first sealing portion 20 shown in FIGS. 5A and 5B and the cable 10 are placed in the metal mold, and the material for the second sealing portion 21 is injected into the metal mold to form the second sealing portion 21. At this time, the second sealing portion 21 is formed so as to seal the first sealing portion 20 and be in contact with the main body 1 and the outer coat 11 of the cable 10.

The present invention is not limited to the above-described embodiments, various modifications can be made within the scope of claims, and embodiments obtained by appropriately combining technical means disclosed in various embodiments are also included in the technical scope of the present invention.

The invention claimed is:

1. An electronic device comprising a main body having a function of the electronic device, and a cable that has a tip portion disposed inside the main body and is connected to the main body, wherein the cable includes a lead wire, an insulating portion that covers the lead wire, and an outer coat that covers the insulating portion, the insulating portion protrudes from an end surface on the tip portion side of the outer coat toward the tip portion, and is made of a material that is more resistant to a water-soluble grinding oil than the outer coat is, the electronic device further comprising:

a first sealing portion that seals the insulating portion that protrudes from the end surface; and a second sealing portion that seals the first sealing portion and is in contact with the main body and the outer coat, the first sealing portion being made of a material that has higher adherence to the insulating portion than that of the second sealing portion does.

2. The electronic device according to claim 1, wherein the first sealing portion seals the end surface of the outer coat.

3. The electronic device according to claim 1, wherein the first sealing portion seals the end portion on the tip portion side of the lead wire.

4. The electronic device according to claim 1, wherein the second sealing portion is made of a material that has higher adherence to the outer coat than that of the first sealing portion does.

5. The electronic device according to claim 1, wherein the material for forming the insulating portion is a fluorine-based resin, and the material for forming the first sealing portion is a polyamide-based resin.

6. The electronic device according to claim 5, wherein a material for forming the outer coat is a polyvinyl chloride resin, and the material for forming the second sealing portion is a polybutylene terephthalate resin.

7. A method for manufacturing an electronic device including a main body having a function of the electronic device, and a cable that has a tip portion disposed inside the main body and is connected to the main body, the method comprising:

a step of disposing, in the main body, a tip portion of the cable including a lead wire, an insulating portion that covers the lead wire, and an outer coat that covers the insulating portion;

a step of forming a first sealing portion that seals the insulating portion that protrudes from an end surface on the tip portion side of the outer coat toward the tip portion; and a step of forming a second sealing portion that seals the first sealing portion and is in contact with the main body and the outer coat, wherein the insulating portion is made of a material that is more resistant to a water-soluble grinding oil than the outer coat is, and the first sealing portion is made of a material that has higher adherence to the insulating portion than that of the second sealing portion does.

* * * * *